US008800790B2

(12) United States Patent
Holopainen et al.

(10) Patent No.: US 8,800,790 B2
(45) Date of Patent: Aug. 12, 2014

(54) ARRANGEMENT FOR INSTALLING CABLES ON OUTER SURFACES OF CRANE STRUCTURES

(75) Inventors: Arto Holopainen, Hyvinkää (FI); Mirko Nowak, Dessau (DE); Petri Salminen, Viiala (FI)

(73) Assignee: Konecranes PLC, Hyvinkaa (FI)

( * ) Notice: Subject to any disclaimer, the term of this patent is extended or adjusted under 35 U.S.C. 154(b) by 943 days.

(21) Appl. No.: 12/673,436

(22) PCT Filed: Aug. 13, 2008

(86) PCT No.: PCT/FI2008/050457

§ 371 (c)(1),
(2), (4) Date: Feb. 12, 2010

(87) PCT Pub. No.: WO2009/022057

PCT Pub. Date: Feb. 19, 2009

(65) Prior Publication Data

US 2010/0213324 A1 Aug. 26, 2010

(30) Foreign Application Priority Data

Aug. 15, 2007 (FI) ..... 20075570

(51) Int. Cl.
*B66C 25/00* (2006.01)

(52) U.S. Cl.
USPC ..... 212/271; 174/72 A

(58) Field of Classification Search
USPC ..... 174/100, 135, 68.1, 68.3, 72 A, 72 R, 174/88 R, 70 C; 248/65, 58, 68.1; 212/271
See application file for complete search history.

(56) References Cited

U.S. PATENT DOCUMENTS

| | | | | |
|---|---|---|---|---|
| 2,764,626 | A * | 9/1956 | Teichroew | 174/174 |
| 3,944,719 | A | 3/1976 | Rubey | |
| 4,566,502 | A | 1/1986 | Kellogg | |
| 6,483,025 | B1 | 11/2002 | Samsi et al. | |
| 2007/0108150 | A1 * | 5/2007 | Oja | 212/324 |

FOREIGN PATENT DOCUMENTS

| | | | |
|---|---|---|---|
| DE | 84 22 477 | U1 | 11/1984 |
| DE | 34 22 955 | A1 | 1/1986 |
| EP | 0 723 102 | A2 | 7/1996 |
| JP | 60-188295 | A | 9/1985 |
| JP | 5-14250 | U | 2/1993 |
| WO | WO 82/00843 | A1 | 3/1982 |

* cited by examiner

*Primary Examiner* — Sang Kim
*Assistant Examiner* — Juan Campos, Jr.
(74) *Attorney, Agent, or Firm* — Birch, Stewart, Kolasch & Birch, LLP

(57) ABSTRACT

The invention relates to an arrangement for installing cables on outer surfaces of crane structures (1), the arrangement comprising means (9) for routing and fastening cables to said surfaces. These means consist of T profiles (9) fastened at the stem part (10) of the T profile to the outer surface (1) of the crane structure, the upper part (11) of the T profile on top of and transverse to the stem part of the T profile being at a distance from the surface of the crane and substantially parallel to this surface, whereby the T profile together with the surface of the crane provide cable conduits (12) for the cables, which are open from the sides.

15 Claims, 2 Drawing Sheets

ARRANGEMENT FOR INSTALLING CABLES ON OUTER SURFACES OF CRANE STRUCTURES

BACKGROUND OF THE INVENTION

The invention relates to an arrangement for installing cables on outer surfaces of crane structures, the arrangement comprising means for routing and fastening cables to said surfaces.

The crane in question is a gantry-type of crane on rubber tyres, i.e. an RTG crane, which is used particularly in harbours and in which cables between the bogie structures and upper part of the crane in particular have hitherto been fastened to the crane's footing structures with ladder structures especially formed for the cables.

Cable ladders are usually made of stainless acid-resistant or galvanized steel, and regardless of the material, the fastening has required a lot of different parts, which has made the arrangement very expensive and thus slow to install. Covers made of stainless or acid-resistant steel are often mounted on the cable ladders to protect the cables from impacts and sunlight.

When cable ladders are used, it is obvious that the binding of the cables and the installation of feasible protective covers take a lot of time.

SUMMARY OF THE INVENTION

It is an object of the invention to remove the above-mentioned drawbacks. This object is achieved by an arrangement according to the invention, characterized in that the means for routing and fastening cables mainly consist of T profiles fastened at the stem part of the T profile to the outer surface of the crane structure, the upper part of the T profile on top of and transverse to the stem part of the T profile being at a distance from the surface of the crane and substantially parallel to this surface, whereby the T profile together with the surface of the crane provide cable conduits for the cables, which are open from the sides.

Thus, the invention is simply based on replacing former ladder structures with T profiles.

The arrangement of the invention provides the advantage that considerable cost savings may be achieved with respect to both the structure itself and the installation of the arrangement and the cables.

In addition, no additional protective plates are needed, because the transverse parts of the T profiles parallel to the mounting surfaces, also provide a protection against impacts and sunlight.

LIST OF FIGURES

Figure 1:
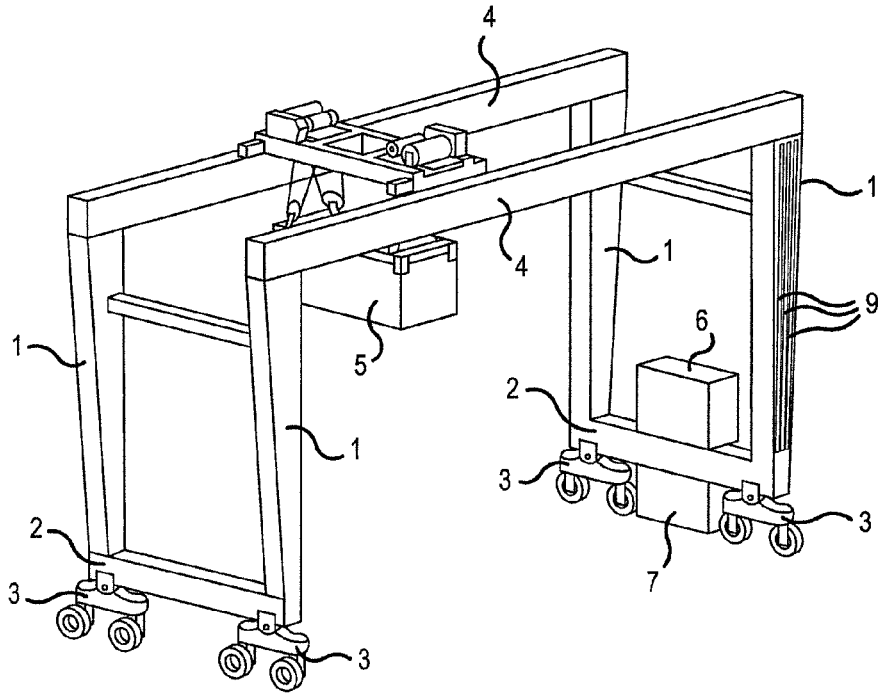
Figure 2:
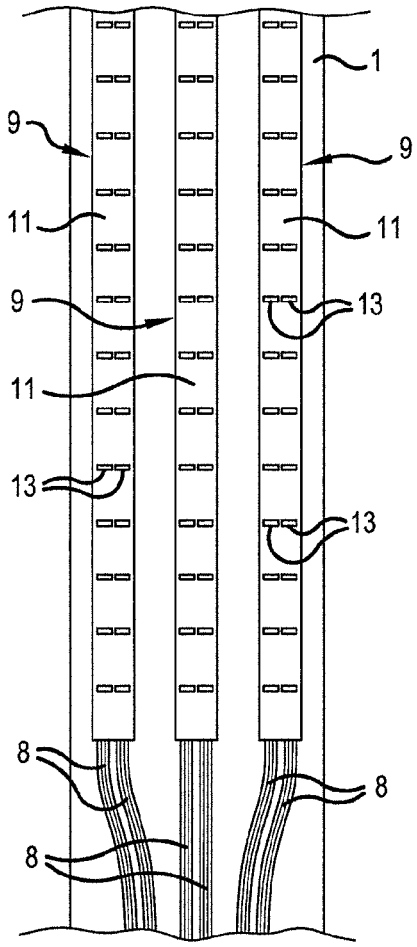
Figure 3:
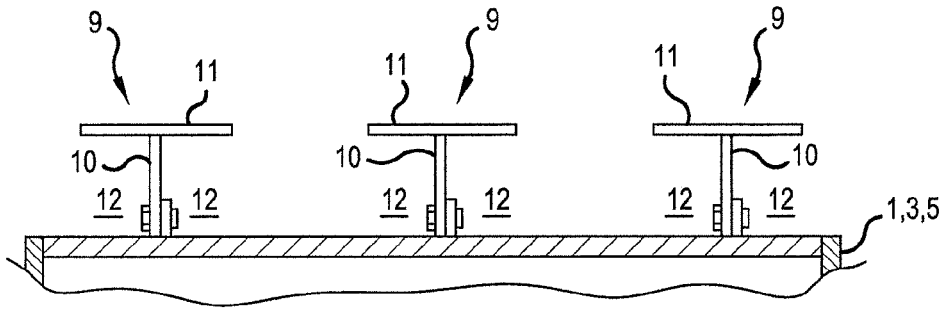

The invention will now be described in greater detail by means of an exemplary preferred embodiment in connection with an RTG crane, with reference to the attached drawings, in which FIG. 1 is a simplified schematic view of an RTG crane, in connection with which the present invention is applied;

FIG. 2 shows in more detail a cable conduit formed of T profiles on a foot of the crane of FIG. 1, and cables sketched therein; and FIG. 3 is a cross section of various surfaces of the RTG crane having the T profiles without cables.

DETAILED DESCRIPTION OF THE INVENTION

With reference to FIG. 1, it shows a simplification of a gantry-type of crane on rubber tyres, i.e. an RTG crane, which is used particularly in harbours and to which the present invention is particularly well suited. The crane has four feet 1, bogie structures 3 connected, together with lower beam structures 2 joining two feet 1, to the lower parts of the feet 1, upper beam structures 4 connected to the upper parts of the feet 1 and extending transversally to the lower beam structures 2, a trolley 5 movable along the upper beam structures 4, and a switchboard 6 driven by motors 7. Cables 8 necessary for power supply extend, for example, along the feet 1 between the bogie structures 3 and the upper beam structures 4, and routing and fastening manners of the cables are now discussed in more detail.

As particularly shown in FIGS. 2 and 3, the means for routing and fastening cables 8 include T profiles 9, which are fastened at a stem part 10 of the T profile to the outer surface of the crane structure, in this example to the outer surface of the crane foot 1, the upper part or the transverse part 11 of the T profile on top of and transverse to the stem part 10 of the T profile being at a distance from the surface of the crane and substantially parallel to this surface, whereby the T profile 9 together with the surface of the crane provide cable conduits 12 for the cables 8, which are open from the sides.

As shown in FIG. 2, the T profiles 9 are mounted vertically on the foot structures 1 of the RTG crane and the cables 8 extend between bogie structures 3 arranged at the lower parts of the crane feet 1 and upper beam structures 4 connected to the crane feet 1 at the top.

It is also possible to mount T profiles on the bottom of the trolley 5 movable along the upper beam structures 4 and/or on the sides of the bogie structures 3, as shown in FIG. 3 because they also include cabling (not shown for clarity).

T profiles may be made of painted structural steel, since no special steel grades are necessarily required.

For binding the cables 8 and the binding means thereof, the transverse upper parts of the T profiles are provided with perforations or slots 13.

The T profiles 9 are fastened to the crane most preferably by screws. Much fewer screws are needed than in the former manner of fastening cable ladders.

The above description of the invention is only intended to illustrate the invention. A person skilled in the art may, however, apply it to many different uses and implement its details suitably within the scope of the attached claims.

The invention claimed is:

1. An arrangement for installing cables on outer surfaces of crane structures, the arrangement comprising:

T profiles configured to route cables to at least one outer surface of said outer surfaces, each T profile including a stem part and an upper part formed as a continuously extending member in a longitudinal direction, each upper part extending greater in the longitudinal direction than in a lateral direction, each T profile having a plurality of slots or perforations formed in the upper part, each of the slots or perforations extending greater in the lateral direction than in the longitudinal direction such that the lateral direction is arranged perpendicular to the longitudinal direction of the continuous T profile, the plurality of slots or perforations being spaced from outer edges of the upper part, wherein the T profiles are fastened at the stem part of the T profile to the at least one outer surface of the crane structure, the upper part of the T profile on top of and transverse to the stem part of the T profile being at a distance from the at least one outer surface of the crane and substantially parallel to the at least one outer surface, whereby the T profile together with the at least one outer surface of the crane provide cable conduits for the cables, which are open from the sides.

2. An arrangement as claimed in claim 1, wherein the T profiles are configured to be mounted vertically on crane feet structures of an RTG crane, where the cables extend between bogie structures arranged at lower parts of the crane feet and upper beam structures connected to top parts of the crane feet.

3. An arrangement as claimed in claim 2, wherein the T profiles are configured to be mounted on a bottom of a trolley moving along upper beam structures of an RTG crane.

4. An arrangement as claimed in claim 2, wherein the T profiles are configured to be mounted on sides of bogie structures arranged at lower parts of crane feet of an RTG crane.

5. An arrangement as claimed in claim 2, wherein the T profiles are made of painted structural steel.

6. An arrangement as claimed in claim 2, wherein the T profiles are fastened to the crane by threaded fasteners.

7. An arrangement as claimed in claim 1, wherein the T profiles are configured to be mounted on a bottom of a trolley moving along upper beam structures of an RTG crane.

8. An arrangement as claimed in claim 7, wherein the T profiles are configured to be mounted on sides of bogie structures arranged at lower parts of crane feet of an RTG crane.

9. An arrangement as claimed in claim 7, wherein the T profiles are made of painted structural steel.

10. An arrangement as claimed in claim 7, wherein the T profiles are fastened to the crane by threaded fasteners.

11. An arrangement as claimed in claim 1, wherein the T profiles are configured to be mounted on sides of bogie structures arranged at lower parts of crane feet of an RTG crane.

12. An arrangement as claimed in claim 11, wherein the T profiles are made of painted structural steel.

13. An arrangement as claimed in claim 11, wherein the T profiles are fastened to the crane by threaded fasteners.

14. An arrangement as claimed in claim 1, wherein the T profiles are made of painted structural steel.

15. An arrangement as claimed in claim 1, wherein the T profiles are fastened to the crane by threaded fasteners.

* * * * *